US005361422A

United States Patent [19]

Vincent et al.

[11] Patent Number: 5,361,422

[45] Date of Patent: Nov. 8, 1994

[54] TOILET VENTILATING SYSTEM

[75] Inventors: Cynthia Vincent, Huntington Beach, Calif.; Ray T. Vincent, 504 Terry Ave. #106, Seattle, Wash. 98104

[73] Assignee: Ray T. Vincent, Seattle, Wash.

[21] Appl. No.: 64,217

[22] Filed: May 21, 1993

[51] Int. Cl.[5] ..... E03D 9/052

[52] U.S. Cl. ..... 4/213; 4/216

[58] Field of Search ..... 4/213, 217, 211, 214, 4/215, 216, 346, 349, 350, 351, 352

[56] References Cited

U.S. PATENT DOCUMENTS

| | | | |
|---|---|---|---|
| 1,456,196 | 5/1923 | Staats | 4/DIG. 3 |
| 3,579,650 | 5/1971 | Sloan | 4/347 |
| 3,781,923 | 1/1974 | Maisch et al. | 4/213 |
| 4,726,078 | 2/1988 | Carballo et al. | 4/213 |
| 4,800,596 | 1/1989 | Menge | 4/348 |
| 4,880,027 | 11/1991 | Menge | 4/213 X |
| 4,984,310 | 1/1991 | Casale | 4/347 |
| 4,985,944 | 1/1991 | Shaw | 4/DIG. 15 |
| 5,016,294 | 5/1991 | Canovas | 4/217 |
| 5,029,346 | 7/1991 | Fernald, Sr. | 4/213 |
| 5,210,884 | 5/1993 | Redford | 4/213 X |

*Primary Examiner*—Robert M. Fetsuga

*Attorney, Agent, or Firm*—Fulwider, Patton, Lee & Utecht

[57] ABSTRACT

A toilet ventilating system for use with a bowl incorporating a sewer line connection and including an upstanding vent conduit leading from the bowl rim outlets to an elevated cross over in the water storage tank and then dropping downwardly to form an exhaust conduit connected with the sewer connection. A centrifugal fan having a flow rate of 60 cubic feet per minute is incorporated in the vent conduit and a trap valve is incorporated in the cross over for selectively opening and closing communication between the vent conduit and the exhaust conduit. The trap valve incorporates a floating cylinder, positioning of which is controlled by water pumped from an elevated reservoir through a positive displacement pump. A controller is provided for controlling the positive displacement pump to open the trap valve, actuation of the centrifugal fan and closure of the trap valve, deactuation of the fan and actuation of the flush valve.

15 Claims, 3 Drawing Sheets

TOILET VENTILATING SYSTEM

BACKGROUND OF THE INVENTION

1.Field of the Invention

The present invention relates to a ventilation system incorporated in a toilet to remove offensive odors during use to be dispensed directly to the sewer line.

2. Description of the Prior Art

Modern day bathrooms often incorporate high volume exhaust fans connected either in parallel with the light switch or connected with a separate exhaust fan operating switch for actuation thereof to remove offensive odors during use of the toilet. The shortcomings of such exhaust systems has long been recognized. By their very nature, bathrooms typically fill with offensive odors during use. Such odors are only partially withdrawn therefrom during any reasonable period of exhaust fan operation. Thus, when the bathroom door is opened or another user subsequently enters, offensive odors often remain thus leaving a socially embarrassing situation. Recognition of these shortcomings in conventional exhaust systems has led to the proposal of numerous different exhaust or ventilating devices to be incorporated directly in the toilet bowl in effort to provide for direct exhaust to either the atmosphere or directly to the sewer system.

One such device proposed contemplated a serpentine construction of multiple air traps formed in conduits installed in the water storage tank and operated by means of a complicated venting and drainage system requiring flow of control air through air control valves under influence of a water jet. A device of this type is shown in U.S. Pat. No. 3,579,650 to Sloan. Such an arrangement, while satisfactory for selected situations, suffers the shortcoming that the flush water must pass through a vent tube and that the air control valves serves to choke air flow thus severely limiting the volume of exhaust air available during use.

Other efforts have led to the proposal of custom design toilet bowls with rather complicated conduit arrangements and incorporating a secondary water storage tank with control elements therein. Such devices provide for a blower to be connected to the sewer upstream of a trap valve. A device of this type is shown in U.S. Pat. No. 4,800,596 to Menge. While satisfactory for some applications, systems of this type suffer the shortcoming that the toilet bowl construction required is rather complex and expensive to manufacture and requires a storage tank having an unacceptably high profile. Furthermore, in a design of this type the water trap is not utilized as the first barrier to the sewer. The assurance of a leak-free system is wasted by having placed the blower between the sewer line and the water trap. Moreover, the control systems utilized in this type are dependent on the availability of water pressure in the water main thus rendering such devices inoperable when water pressure is low or non-existent.

Other efforts to provide a satisfactory exhaust system have led to the proposal of another custom styled toilet bowl construction, mounting a water storage tank requiring a pneumatic seal for proper operation and which vents exhaust gases to the atmosphere. A device of this type is shown in U.S Pat. No. 5,029,346 to Fernald. While providing some improvement in operation, devices of this type suffer the shortcoming that the toil bowl construction is relatively expensive to manufacture and the use of the tank's overflow tube as an exhaust conduit severely limits airflow due to its small cross-section resulting in residual offensive odors remaining even after operation.

Thus, there exists a need for a toilet bowl ventilating system which provides for a high volume of exhaust air flow during use to be introduced directly to the sewer line and which will positively close off communication with such sewer line during the flush cycle and during any remedial household measures taken to rectify plugging of the sewer line as by application of conventional household plungers to the drain from the toilet bowl.

SUMMARY OF THE INVENTION

The present invention is characterized by a vent conduit leading from the flush openings in the rim of a toilet bowl, crossing over to turn downward to form an exhaust conduit connected with the sewer line. A trap valve is mounted in the crossover and is controlled by water from a small reservoir. A controller controls flow from the reservoir to the trap valve, a high volume air fan included in the crossover, and the flush valve.

DESCRIPTION OF THE PREFERRED EMBODIMENT

Figure 1:
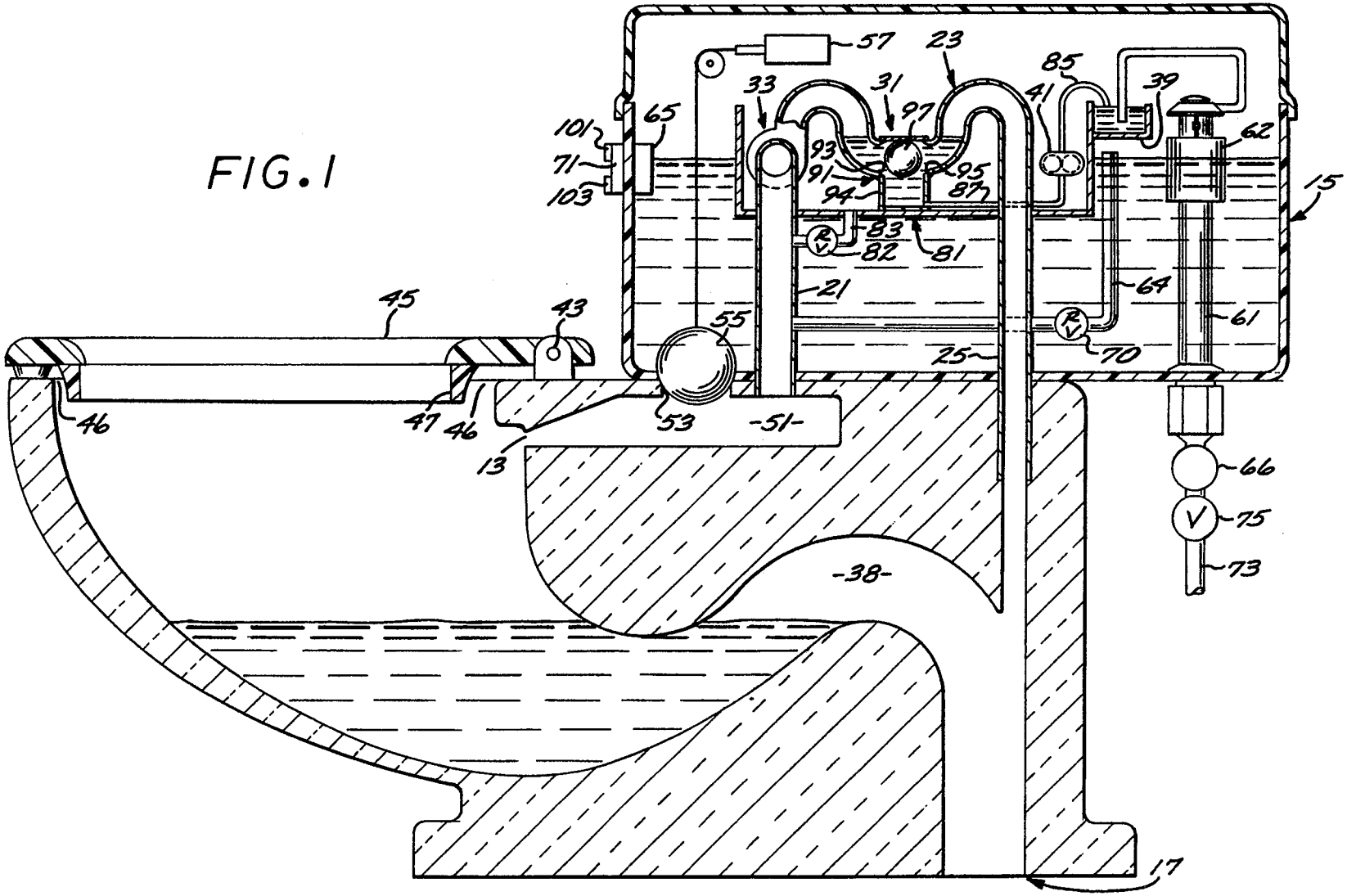
FIG. 1 is a schematic diagram of a toilet ventilating system embodying the present invention.

The toilet bowl ventilating system of the present invention includes, generally, a toilet bowl 11 formed with flush inlets 13 spaced around the rim thereof. Surmounted on the bowl is a water storage tank 15 and incorporated in the bottom of such bowl is a sewer connection 17. Rising upwardly within the tank 15 is a upstanding ventilating conduit 21 which projects through the bottom wall of a separating compartment, generally designated 81, and turns laterally to form a cross over 23 and then turns downwardly to form an exhaust conduit 25. Incorporated in the cross over 23 is a water actuated trap valve 31 which is actuated by water from a reservoir 39 pumped through a positive displacement pump 41. Water flow to the reservoir 39 is controlled by the float valve 61 and its float 62, or by a solenoid valve 66 which will override the float valve if the controller senses the flush valve 55 leaking. Exhaust air is driven through the ventilating conduit 21 by means of a high volume fan 33. A controller, generally designated 71, controls the sequence of operation.

The toilet bowl 11 is of rather straight forward construction and is formed with the conventional upturned elbow defining a flush passage 38. Mounted on the rim of the bowl 11 by means of a hinge pin 43 is a bowl lid 45 in spaced apart relation to form between the bottom side thereof and the toilet bowl rim a parametrical intake passage 46 for exhaust air. An annular downwardly projecting air foil 47 is mounted underneath the lid 45 in confronting relationship with the annular parametrical inlet 46 to thus deflect radially inwardly flowing air downwardly and away from the buttocks of the user.

Exhaust air is communicated from the inlets 13 through a plenum chamber 51 to the ventilating conduit 21. The conduits 21 and 25 and the cross over 23 are sufficiently great in transverse cross section to form a flow passage which, when the fan 33 is actuated, will provide for flow of exhaust air of a rate of at least 30 cubic feet per minute and preferably in the amount of 60 cubic feet per minute to thereby positively provide for a high flow of exhaust air for positive venting of any offensive odors.

Water is introduced to the storage tank 15 through a water inlet conduit 73 having flow controlled therethrough by means of a manual shut-off water supply valve 75 and a solenoid actuated valve 66 to supply water flow to the inlet of the float valve 61 controlling flow to the reservoir 39. The inlet of the pump 41 is connected with a reservoir conduit 85 and the outlet thereof is connected with the trap valve 31 by means of an actuator conduit 87.

Figure 2:
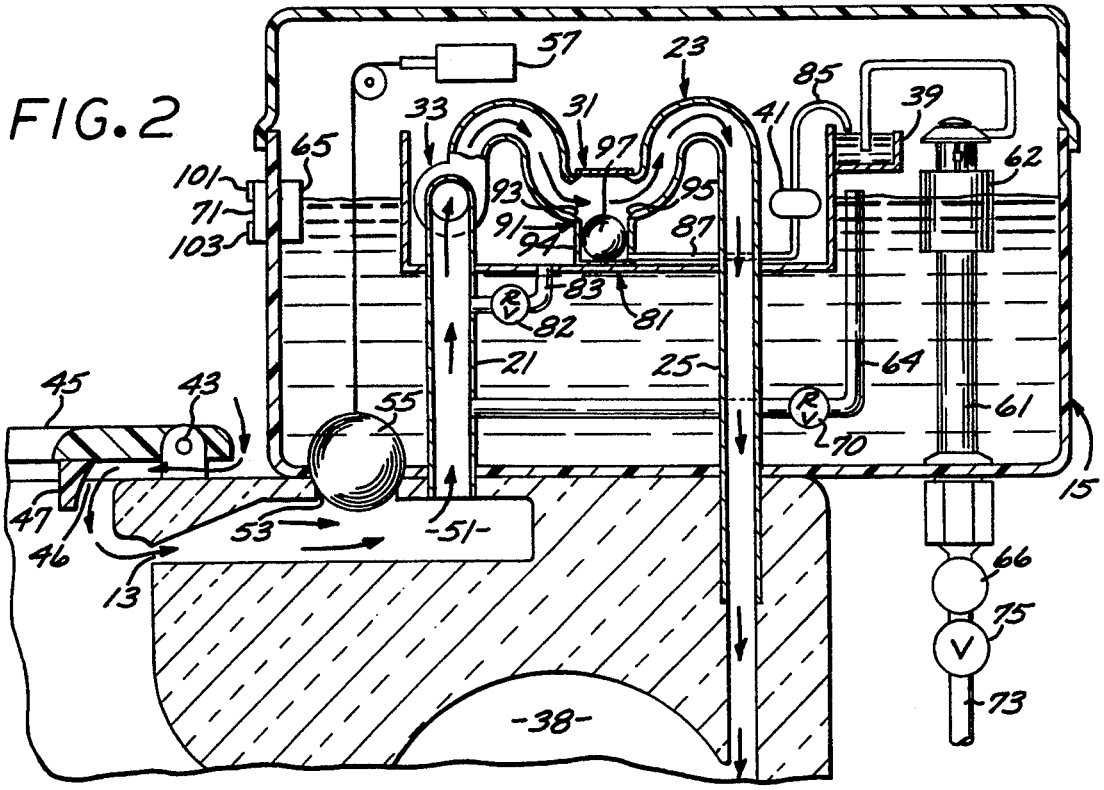
FIG. 2 is a schematic diagram similar to FIG. 1 but showing the system ventilating.
Figure 3:
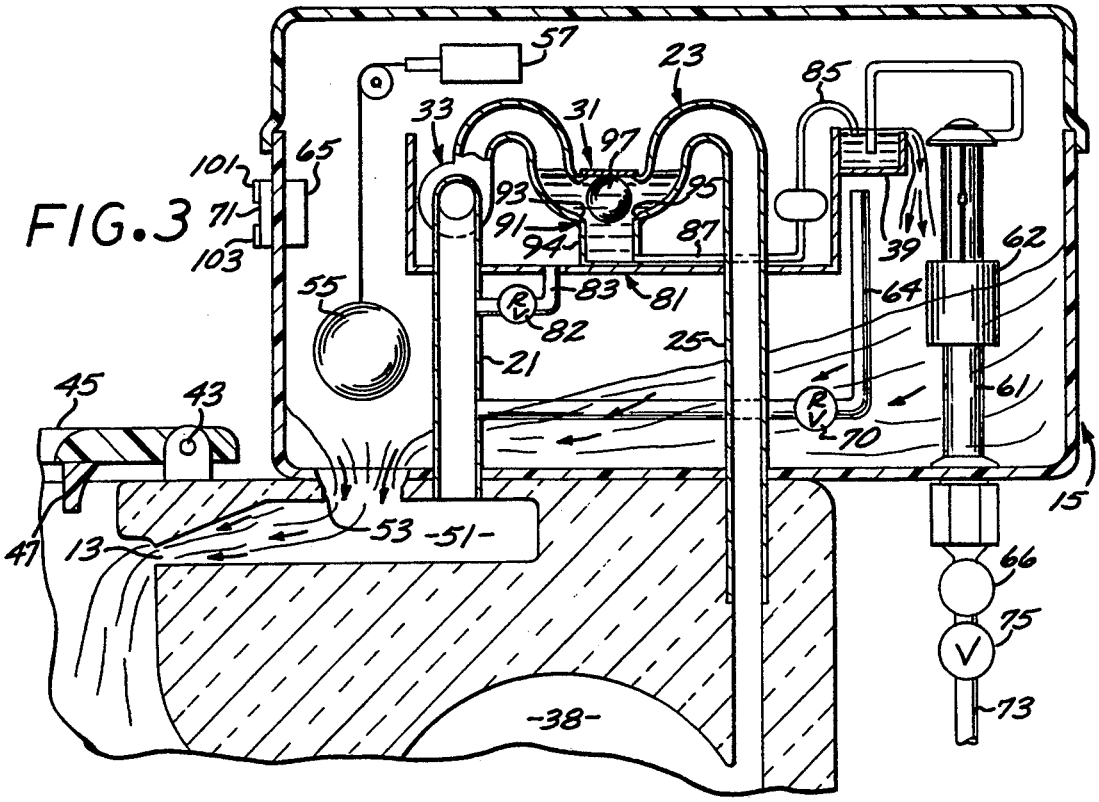
FIG. 3 is a schematic diagram similar to FIG. 1 but showing system flushing.

The vent conduit 21 and exhaust conduit 25 are formed in their upper extremities with goose necks which turn downwardly in the cross over 23 to form a valve body, generally designated 91 (FIG. 3). The valve body 91 is formed on its opposite sides with respective valve seats 93 and 95. The valve seat 93 forms a tight seal with a float 97 to act as a flush suction seat as described hereinafter. The other seat 93 forms a loose fit with the float 97 when seated thereagainst to provide a back pressure seat as described below. The valve body 91 is carried on a conduit stub 94, from which the float 97 is floated. In practice, the float is in the form of an upright cylinder configured to be received complementally in the conduit stem 94 so as to maintain its vertical orientation as it is floated upwardly. As shown in FIG. 2, the connector conduit 87 from the actuator pump 41 connects with the bottom of the stem conduit 94 so as to fill and withdraw floatation water therefrom as described below.

A ball, forming the flush valve 55, is suspended from a flush control solenoid 57 connected in circuit with the controller 71. A water level sensor 65 mounted on the inner wall of the tank 15 is provided to sense the water level and is connected in circuit with the controller to, upon sensing of a lowering of the water, open the solenoid valve 66 in the supply line 73 to introduce replacement water. The controller 71 includes a counter operative in response to four sequential actuations of the valve 66 to then close such valve and discontinue introduction of water to the storage tank until further actuation of the controller 71. The advantage of this feature is to save water by overriding the float valve 61 in the event the flush valve 55 should develop a leak leading to a continuous water loss.

A conventional float valve 61 is mounted in the tank 15 and includes thereon a float 62 operative to sense filling of the tank to the selected level to thus turn off the flow of water to tank 15 and reservoir 39. An upstanding overflow pipe 64 removes excess water from the tank 15 to the intake pipe 21 and includes a check valve 70.

The compartment 81 is in effect a water tight compartment serving to isolate and protect the pump 41 and blower 33 from the high moisture environment of the water in the tank 15. Water which would collect in compartment 81 will drain through relief tube 83. Relief valve 82 will open upon sensing one inch of water and drain water from the compartment.

An actuator switch 101 is operative upon depression thereof to initiate operation of the controller 71. A restart switch 103 mounted on the exterior wall of the tank 15 is also connected in circuit with the controller 71 and is operative to restart flow of water to the tank as described hereinafter.

In operation, it will be appreciated that the ventilating system of the present invention is relatively easy to install and may be incorporated in a bowl 11 of generally conventional configuration and in a tank 15 of conventional exterior dimensions. It will be appreciated that the controller 71 is typically in the form of a microprocessor connected in electrical circuit with the water level sensor 65, flush solenoid 57, actuator pump 41 and blower 33.

The toilet, when not in use, will remain generally in the mode shown in FIG. 1, with the flush valve 55 and trap valve 31 closed and the actuator pump 41 inoperative. When a user elects to actuate the ventilating system, the actuator switch 101 will be depressed to energize the micro processor 71. The controller will energize the actuator pump 41 to pump water in the reverse flow direction from the conduit stub 94 of the trap 31 to thus lower the floating cylinder 97 to shift it out of alignment with the respective valve seats 93 and 95. The controller then energizes the variable speed fan 33 to thus create a partial vacuum in the vent conduit 21 to draw air into the openings 13 thus creating a partial vacuum under the buttocks of the users to thus generate a pressure differential sufficient to draw air underneath the periphery of the toilet seat 45 to generate a somewhat venturi effect drawing any offensive gases out through the opening 13, through the vent conduit 21, fan 33 and across the crossover 23 to exhaust down the exhaust conduit 25 through the sewer connection 17 into the sewer.

It is significant that the speed of the fan 33 is adjustable to provide a flow rate through the conduits 21 and 25 and the crossover 23 sufficient for a 60 cubic feet per minute (CFM) flow rate to thereby positively provide a flow rate sufficient to vent all the offensive gases and leave the bathroom relatively odor free. A flow rate of 60 CFM is considered sufficient to positively exhaust all such offensive odors. Flow rates less than 60 CFM, down to about 30 CFM, are relatively effective in exhausting offensive odors but it is preferable that the fan have a high volume rate of 60 CFM to assure very effective operation, even with a slight sewer back pressure.

The annular baffle 47 under the toilet seat lid 45 is effective to deflect inflowing air downwardly away from the user's buttocks to thus prevent direct contact of air flow stream which might afford some discomfort to the user.

At the conclusion of use, the user may depress the flush switch 103 to again actuate the controller to reverse the actuator pump 41 and pump water from the reservoir to the trap valve stem to float the cylinder 97 into alignment with the flush seat 93. As will be appreciated by those skilled in the art, other of the many benefits from the construction of the trap valve 31 is that, during flushing, water rushing to the sewer line generates a partial vacuum which facilitates drawing of a rapid flow rate of flush water to the sewer line. Since this beneficial partial vacuum will be rendered ineffective if the trap valve 31 is drained thus opening the trap valve 31 to the atmosphere, the floating cylinder 97 is configured to be drawn to the right thus engaging the seat 95 to be positively seated.

The flush solenoid 57 is then energized to raise the flush valve 55 and initiate flow of flush water into the bowl 11. As the water level lowers, the float 62 will be lowered to thus open the float valve 61 to introduce water to the reservoir 39 to spill over into the tank and fill such tank. When the float 62 senses filling of the tank 15 to the normal level, it will operate to close the float valve 61 and discontinue filling. The toilet is then ready for use by the next user.

It will be appreciated that in this state, the reservoir 39 remains filled so as to maintain a supply of reserved floatation water to be available even in the event of a failure or loss of pressure in the main water line which might otherwise inhibit actuation of the trap valve 31.

It will be appreciated that when the floating cylinder 97 is floated, as shown in FIG. 1, during the flushing process, when a partial pressure is drawn in the sewer line (FIG. 3), the floating cylinder 97 will be drawn to the right to thus engage the flush valve seat 95 to thereby positively block any unwanted flow of water or air through the trap valve to the sewer.

Figure 4:
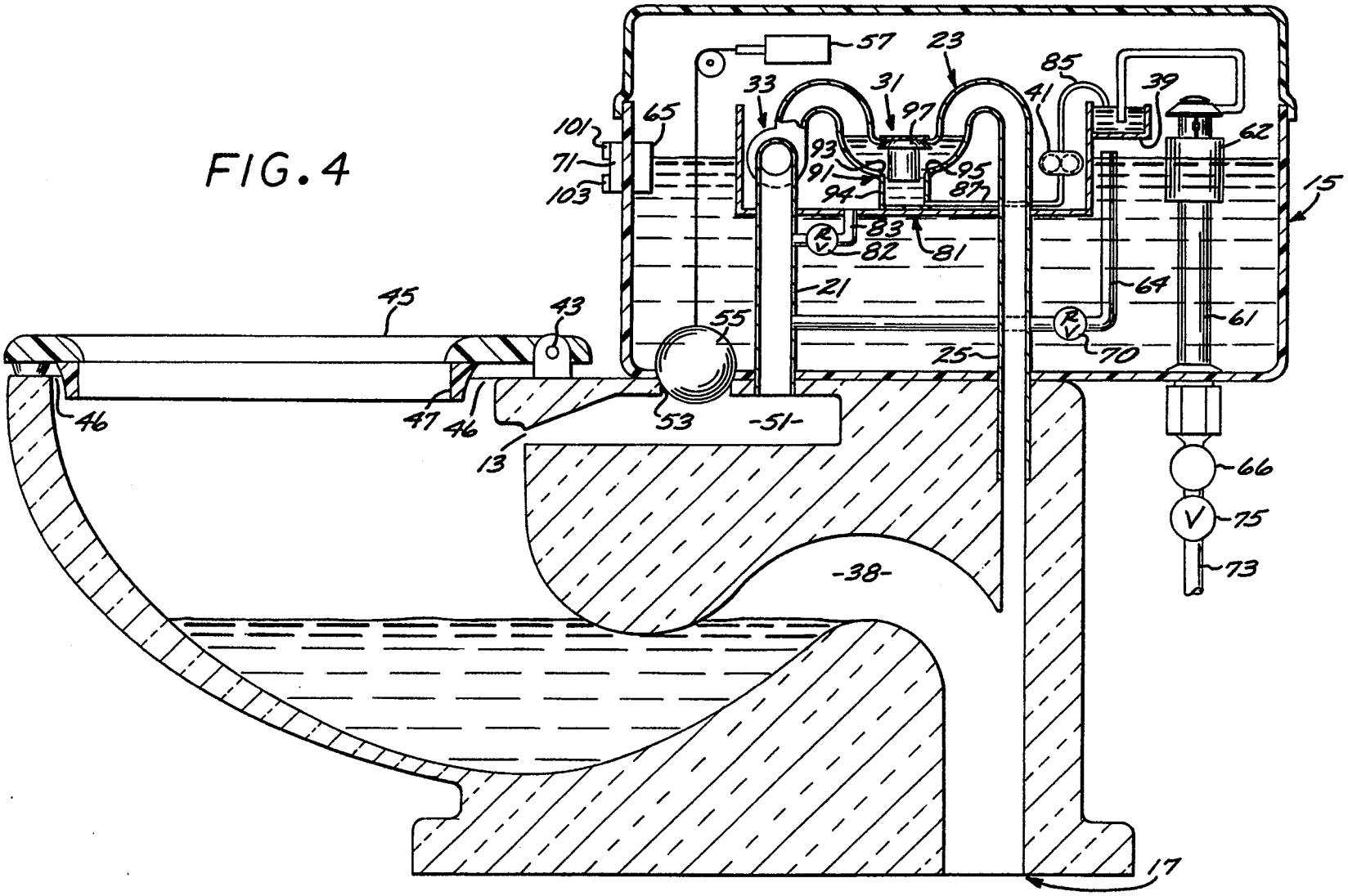
FIG. 4 is a schematic diagram of a second embodiment of the toilet ventilating system of the present invention.

Referring to FIG. 4, the embodiment shown therein is the same as that shown in FIGS. 1–3 except that the float 97' is cylindrical in shape to, when water is pumped from the stem 94, nest downwardly in such stem and be guided therein.

Another advantage of the construction of trap valve 31 shown is that when the toilet is not in use and the floating cylinder 97 is floated, any back pressure generated by application of pressure to the downstream side of the floating cylinder 97, as by pressure applied through the exhaust conduit 25, will drive the floating cylinder 97 to the left to engage the loose fitting back flow seat 93 thus blocking flow to the left past such valve. Thus, in the event of, for instance, momentary application of pressure to the sewer line as by actuation of a conventional household plunger applied to the bowl, such momentary pressure build up applied to the exhaust conduit 25 and to the right hand side of the floating cylinder 97 will then tend to seat such ball on the loose fitting seat 93 to block unwanted flow which would otherwise prevent the desired build up of momentary pressure to clear the sewer line. These pressure peaks which can damage the plastic trap valve and conduits, will be dampened slightly by seepage between the floating cylinder and the loose fitting seat 93.

From the foregoing, it will be apparent that the ventilating system of the present invention is relatively inexpensive to manufacture and will provide for positive ventilation of bathroom odors directly to the sewer, all without unwanted communication of sewer gases back to the bathroom.

What is claimed is:

1. A toilet vent system comprising;

a bowl having a sewer connector and formed with at least one vent opening and a water storage tank, including a flush valve;

a vent conduit leading from said opening upwardly in said storage tank and turning to define a cross over, and to then turn downwardly to define an exhaust conduit connecting with said sewer connector to thereby form a vent air flow path from said opening, through said cross over, through said exhaust conduit to said sewer connector;

a water trap valve in said cross over and including a trap chamber to be filled with water to block flow between said conduits;

a trap valve actuator pump connected with said chamber and operative in response to a trap open valve signal to drain water from said chamber and open said trap valve to provide for flow of air therethrough and further responsive to a trap close valve signal to fill said chamber and block flow between said conduits;

an exhaust fan device in said vent conduit to draw air from said bowl to flow through said trap valve and out said exhaust conduit;

a controller connected with said trap valve actuator and said exhaust fan device, including a control switch, and operative to generate said trap open signal to actuate said actuator to drain said chamber and open said trap valve so that actuation of said fan device will draw air out of said bowl to flow it through said valve trap and out said exhaust conduit, said controller further operative to generate said trap close signal to actuate said actuator to fill said chamber, closing said trap valve such that said flush valve may be actuated to flush water from said bowl with said trap valve closed blocking fluid communication from said vent conduit to said exhaust conduit.

2. A toilet vent system according to claim 1 wherein:

said toilet bowl includes a rim and a toilet seat spaced from said rim to form a peripheral ambient air inlet for passage of air in a flow path from the bathroom to said outlet toilet seat and an air foil mounted thereunder and in said flow path to deflect said ambient air downwardly.

3. A toilet vent system according to claim 1 that includes:

a solenoid connected with said controller for controlling said flush valve.

4. A toilet vent system according to claim 1 that includes:

a water level detector in said tank for detecting the level of stored water when said tank is full, said detector being responsive to lowering of said water to generate a low level signal and to a full level of said water to generate a shut off signal;

a solenoid actuated fill valve for controlling water filling said water tank; and an operator connected in circuit with said detector and said solenoid actuated fill valve;

said operator being responsive to said low level signal to open said fill valve and to said shut off signal to close said fill valve.

5. A toilet vent system according to claim 4 that includes:

a controller having a counter connected with said detector and responsive to a predetermined number of said low level signals to generate a shut off signal; and said operator is responsive to said shut off signal to shut off said fill valve.

6. A toilet vent system according to claim 5 wherein:

said controller includes control means responsive to said shut off signal, followed by said start signal; to open said shut off valve.

7. A toilet vent system according to claim 1 wherein:

said water valve trap includes a vertically extending, circular in cross section upstanding stem defining said float retraction chamber and wherein:

said float is in the form of a cylinder received floatably in said retraction chamber.

8. A toilet vent system according to claim 1 wherein:

said valve trap includes disposed in spaced apart opposed relation a back pressure seat and a flush seat and further includes interposed in vertical alignment between said back pressure and flush suction seats, a vertical stem defining said retraction chamber and wherein:

said float is configured and arranged to, when said chamber is drained, be disposed in said retraction chamber and to, when said chamber is filled with a predetermined volume of water, be disposed between said seats to, in the event of a momentary pressure build up on either side, to be floated toward the opposite side to be seated against the opposing seat to limit the escape of fluid past said flush seat.

9. A toilet vent system according to claim 8 wherein:

said trap valve actuator includes a small volume water reservoir, an actuator conduit for supplying water to said reservoir, and a controller means for controlling water to said reservoir.

10. A toilet vent system according to claim 8 wherein:

said actuator includes an actuator conduit leading from said reservoir to said chamber and a reversible pump in said actuator conduit for selectively pumping water from said reservoir to said chamber and from said chamber to said reservoir.

11. A toilet vent system according to claim 1 wherein:

said actuator pump is a reversible pump.

12. A toilet vent system comprising:

a bowl having a sewer connector and formed with vent openings and including a water storage tank and a flush valve;

a vent conduit leading from said openings upwardly in said storage tank and turning to define a cross over, and to then turn downwardly to define an exhaust conduit connecting with said sewer connector to thereby form a vent air flow path from said openings, through said cross over and said exhaust conduit to said sewer connector;

a trap valve in said cross over including a chamber for receiving water to close;

a trap valve reservoir for receiving actuating water, a filler tube for filling said reservoir;

actuator pump means for pumping actuator water from said reservoir to said trap chamber to block fluid communication from said exhaust conduit to said vent conduit so that said flush valve may be actuated to flush water from said storage tank to said sewer connector while said trap chamber is full, said actuator pump being operable to selectively draw actuator water from said trap chamber to open communication from said vent to said exhaust conduit;

an exhaust fan in said vent conduit for, when said trap chamber is empty, drawing air from said bowl through said trap valve to direct it out said exhaust conduit.

13. A toilet vent system as set forth in claim 12 wherein:

said actuator pump is a reversible pump.

14. A toilet vent system as set forth in claim 13 wherein:

said stub conduit is circular in horizontal cross section; and said float is circular in horizontal cross section.

15. A toilet vent system comprising:

a bowl having a sewer connector formed around its rim with a plurality of flush and vent openings, a water storage tank, a flush valve, a reservoir in said tank, a fill tube leading to said reservoir and including a fill valve;

a vent conduit leading from an inlet in communication with said flush and vent openings projecting upwardly in said storage tank to form a cross over and then projecting downwardly to be formed with an exhaust conduit leading to said sewer connector;

a trap valve in said cross over and including a trap chamber to be filled with water to close said trap valve and a valve chamber formed in its opposite walls with a pair of oppositely disposed, parallel confronting valve openings, one facing upstream to act as a flush opening and the other facing downstream to act as a back pressure opening, an upstanding retraction stub cylinder projecting transversely of said cross over to form a cylindrical retraction chamber, a buoyant float cylinder received in said retraction chamber, floatable into sealing position in alignment with and selectively engageable with said openings, a trap valve actuator for selectively introducing and draining floatation water into and from said retraction reservoir to selectively float and lower said float relative to said seats;

an exhaust fan in said crossover downstream of said trap valve; and a controller coupled with said flush valve and trap valve actuator and operative to actuate said trap valve actuator to draw said floatation water from said trap to open said trap valve so said exhaust fan may be actuated to draw air from said flush and vent openings and flow it through said crossover and down said exhaust conduit, said controller being further operative to actuate said valve trap actuator to introduce said floatation water into said retraction chamber and trap chamber to close said top valve and raise said floating cylinder into sealing position for selective engagement with said back pressure or flush openings.

* * * * *